United States Patent [19]

Greaves et al.

[11] 4,177,010

[45] Dec. 4, 1979

[54] COOLED ROTOR BLADE FOR A GAS TURBINE ENGINE

[75] Inventors: Terence M. Greaves, Kilburn; Robert D. Summers, Long Eaton, both of England

[73] Assignee: Rolls-Royce Limited, London, England

[21] Appl. No.: 888,972

[22] Filed: Mar. 22, 1978

[30] Foreign Application Priority Data

Jan. 4, 1977 [GB] United Kingdom ..... 13808/77

[51] Int. Cl.[2] ..... F01D 5/18

[52] U.S. Cl. ..... 416/97 R; 416/96 A

[58] Field of Search ..... 416/95-97; 415/115, 116, 175

[56] References Cited

U.S. PATENT DOCUMENTS

| | | | |
|---|---|---|---|
| 2,779,565 | 1/1957 | Bruckmann | 416/96 A |
| 3,370,829 | 2/1968 | Banthin et al. | 416/96 A |
| 3,533,711 | 10/1970 | Kercher | 416/96 A X |
| 3,628,885 | 12/1971 | Sidenstick et al. | 416/95 |
| 3,799,696 | 3/1974 | Redman | 416/97 |
| 3,846,041 | 11/1974 | Albani | 416/95 X |
| 3,867,068 | 2/1975 | Corsmeier et al. | 416/96 A X |
| 4,073,599 | 2/1978 | Allen | 416/97 R |

FOREIGN PATENT DOCUMENTS

| | | | |
|---|---|---|---|
| 850090 | 9/1952 | Fed. Rep. of Germany | 416/97 |
| 920641 | 11/1954 | Fed. Rep. of Germany | 416/97 |
| 1282142 | 7/1972 | United Kingdom | 415/115 |

*Primary Examiner*—Everette A. Powell, Jr.

*Attorney, Agent, or Firm*—Cushman, Darby & Cushman

[57] ABSTRACT

A cooled rotorblade has two separate cooling passages or series of passages in its aerofoil. One passage or series communicates with an aperture in the root or shank of the blade for the supply of cooling fluid while the other communicates with a hollow bush mounted in the shank to provide an inlet for cooling fluid. In addition to providing a cooling fluid inlet the bush serves to blank off an interconnection between the otherwise separate passages, the interconnection assisting the manufacturing process.

6 Claims, 4 Drawing Figures

COOLED ROTOR BLADE FOR A GAS TURBINE ENGINE

This invention relates to a cooled rotor blade for a gas turbine engine.

It has been recognised in the past that a particularly effective way to cool such rotor blades involves the use of two separate passages or series of passages within the aerofoil of the blade, the passages of series being fed with different pressures of cooling air or other fluid. However, the provision of a blade structure which enables the two supplies to enter the blade separately and which is capable of being made on a production basis has not been easy.

The present invention relates to a blade structure which admits the two separate feeds of fluid and which eases certain manufacturing problems.

According to the present invention a cooled rotor blade for a gas turbine engine comprises an aerofoil portion, a root portion and a shank portion interconnecting the root portion and the aerofoil portion, an aperture in the root portion or the shank portion through which cooling fluid may flow to feed a first passage or series of passages defined by chordal-spaced spanwise extending partitions between the convex and concave flanks in the aerofoil portion, and a hollow bush mounted in the shank portion so that its hollow centre provides an aperture through which cooling fluid may flow to feed a second separate passage or series of passages in the aerofoil portion.

Said aperture through which fluid may flow to said first set of passages may be formed in the base of the root portion.

Preferably the hollow bush, as well as providing an aperture for entry of the fluid, acts to block off an interconnection or interconnections between the otherwise separate first and second passages or series of passages defined by the partitions. One such interconnection may be formed by a tie member which provides support for a portion of the core used to produce the cooling fluid passages within the aerofoil when the blade is cast.

In one arrangement in accordance with the invention a higher pressure flow of cooling fluid enters at the base of the root and feeds passages adjacent the leading and trailing edges of the aerofoil while a lower pressure flow of fluid enters through the hollow bush and feeds a passage intermediate the leading and trailing edge passages.

The cooling fluid may comprise air.

Figure 1:
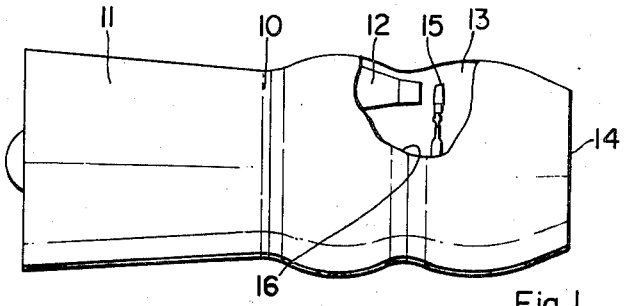
Figure 2:
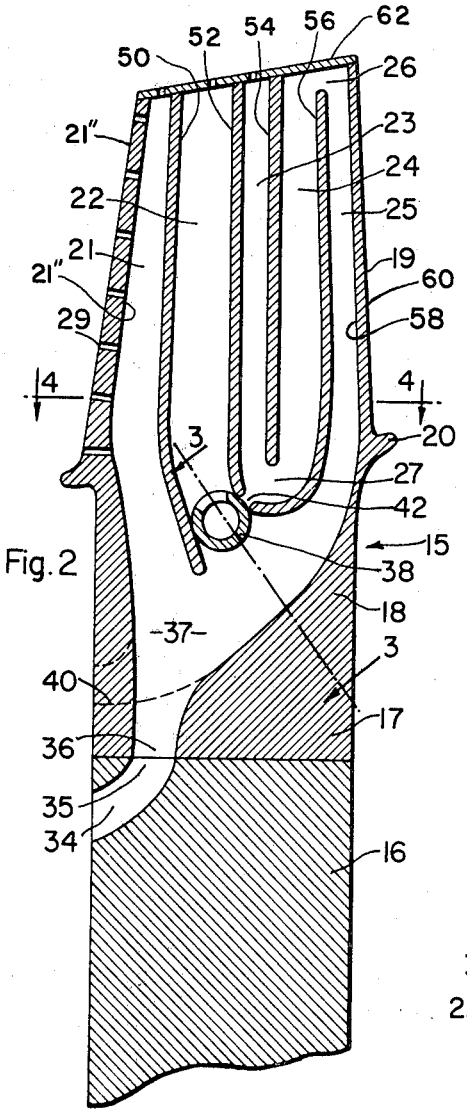
Figure 3:
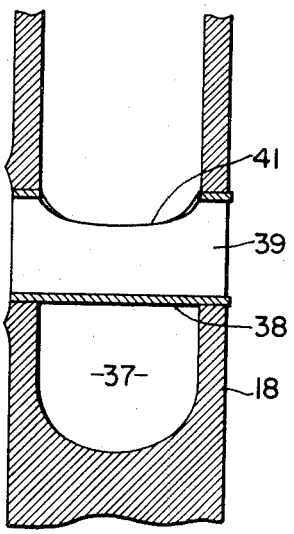
Figure 4:
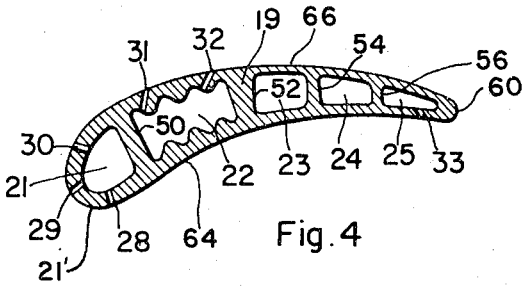

The invention will now be particularly described, merely by way of example, with reference to the accompanying drawings in which:

FIG. 1 is a view of a gas turbine engine having cooled rotor blades in accordance with the invention, FIG. 2 is an enlarged section taken on the mid-chord through one of the rotor blades of FIG. 1, FIG. 3 is a further enlarged section on the line 3—3 of FIG. 2, and FIG. 4 is a section on the line 4—4 of FIG. 2.

In FIG. 1 there is shown a gas turbine engine comprising a casing 10 within which are mounted in flow series a compressor 11, combustion system 12 and turbine 13, and which forms a final nozzle 14. As is normal practice, the compressor takes in and comresses air which is mixed with fuel and burn in the combustion chamber. The resulting hot gases drive the turbine which in turn drives the compressor, and the gases from the turbine pass through the nozzle to produce propulsive thrust.

Because the turbine is subject to the flow of hot gas through it, it has been found necessary to provide cooling for certain parts, normally including the turbine rotor blades. In FIG. 1 the blades 15 are shown attached to their disc 16, and in FIG. 2 there is an enlarged section through the blade 15 which shows the way in which the blade is cooled.

Stated in simple terms, the cooling of the blade is effected by the passage through ducts inside it of a cooling fluid, normally air, and ejection of this fluid on to the surface of the blade in the form of a thin film. As can be seen from FIG. 2, each blade 15 comprises a root portion 17, a shank 18 and an aerofoil 19. A platform 20 forms the dividing feature between the aerofoil 19 and shank 18. The root 17 comprises a shape adapted to engage with a corresponding slot in the periphery of the rotor disc 16, while the shank 18 forms the connection between the root and the aerofoil.

The aerofoil 19 is the part of the blade contacted by hot gases, and it is therefore the aerofoil which must be provided with the greatest degree of cooling. To this end a number of internal passages are provided for the flow of cooling air therethrough. The passages in the aerofoil comprise a leading edge passage 21 defined by the interior surface 21' of the leading edge 21" and a spanwise partition 50 extending from the tip portion 62 between the concave flank 64 and convex flank 66, an intermediate passage 22 defined by the partition 50 and a chordal-spaced spanwise extending partition 52 between the concave flank 64 and convex flank 66, and trailing edge passages 23, 24 and 25 defined by the chordal-spaced spanwise partitions 52, 54 and 56 between the concave flank 64 and convex flank 66 and the interior surface 58 of the trailing edge 60. These latter passages are interconnected to form a single sinuous or multi-pass duct; thus passage 25 is provided with an aperture 26 adjacent the tip of the blade and which communicates with the passage 24, and this passage in turn communicates with the passage 23 by way of the aperture 27 formed in the shank area of the blade just inboard of the platform 20. The flow of air in the passages 23, 24 and 25 is therefore from platform to tip in the passage 23, from tip to platform in the passage 24 and from platform to tip again in the passage 23.

In order to allow the cooling air to flow out onto the outer surface of the aerofoil to effect film cooling of the blade, a number of rows of film cooling holes are provided which connect the passages referred to above with the blade surface. The number and location of these holes will vary with different applications, but in the example described there are three rows of holes 28, 29 and 30 allowing air to flow from the passage 21, two rows 31 and 22 allowing air to flow from the passage 32, and a row 33 allowing air to flow from the passage 25.

Because the pressure outside the blade varies over the surface, being generally high at the leading edge 21" and on the concave flank 64 and low on the convex flank 66, it is necessary to provide different pressures of cooling air to the various passages within the blade so as to allow the cooling air to be able to exhaust on to the surface of the blade against the ambient pressure. For this reason, and to allow the cooling air to traverse the sinuous duct formed by passages 23, 24 and 25, the air fed to the passages 21 and 25 is arranged to be at a higher pressure than that feeding the passage 22, and separate supply arrangements are provided.

Thus a relatively high pressure feed of air is provided by way of ducts 34 in the turbine disc 16, each duct terminating in an aperture 35 in the base of a root-engaging slot in such a position as to register with and seal against a corresponding aperture 36 formed in the base of the root 17. From the aperture 36 a bifurcated passage 37 has a leading section which feeds air to the leading edge passage 21 and a trailing section which feeds air to the trailing edge passage 25. It will be noted that at its bifurcation part of the wall of the passage 37 is formed by the outer wall of a hollow cylindrical bush 38 referred to below which extends transversely through the shank portion 18.

A separate feed of lower pressure air to the passage 22 is provided by the bush 38 whose central aperture 39 forms an inlet in each of the side faces of the shank portion 18 of the blade. In the present instance the bush is thus open at both ends; in some cases it may be preferable to blank off one end.

A hole 41 is cut in the wall of the bush and is arranged to register with the end of the passage 22, so that air entering the hollow bush passes along its central aperture 39, through the hole 41 and into the passage 22. It there cools the blade both by its flow along the passage and by its exit as a film from the holes 31 and 32.

It should be noted that the bush 38, in addition to providing an entry passage for this flow of air, acts to provide a division between the passages 22 and 37 which would otherwise be interconnected, and also blanks off the hole 42 which would otherwise interconnect the passages 22 and 23.

The provision of these interconnections is deliberate, and is done to ease problems in the manufacturing process. Thus when the aerofoil portion 19, shank portion 18 and root portion 17 and the partitions 50, 52, 54 and 56 of the blade 15 are cast as an integral unit, the various passages in its interior are produced by the use of a ceramic core having the shape and disposition of the desired passages. The core is held in the mould, and when the molten metal is poured into the mould, the core defines an area free from metal. The ceramic may subsequently be leached out to leave the desired passages and voids. The tip portion 62 is preferably attached to the cast unit.

Although this process is very successful in producing the desired shape, the ceramic core is rather fragile and difficulties have arisen in the handling and use of these cores, particularly when the core is shaped to form a passage blanked off at one end, as for instance would be the passage 22 and the pair of passages 23 and 24 were it not for the use of the bush 38.

Therefore, in the present arrangement, the core member which will eventually form the passage 22 is connected to the core which will form the passage 37, and the core member which forms the passages 23 and 24 is connected by a tie member which eventually produces the hole 42 to the passage 22. In this way there are no core members simply cantilevered from one end and thus prone to damage; all the passage-forming members are connected at one end to the part which forms the passage 37 and at the other end to a block which forms the termination of all the passages at the tip end of the blade.

However, this provision of interconnections which are unnecessary for the cooling fluid flow requires that some means be used to blank off the unnecessary apertures. The bush 38 does this, because it divides the passage 22 from the passage 37 and blocks off the hole 42 as mentioned above. It thus carries out a dual purpose in a very effective manner.

It will be possible to arrange for the cooling air to enter the blade at a location in the shank or root alternative to the aperture 36; thus in FIG. 2 in broken lines there is shown an inlet 40 which could replace the inlet 36.

It will be noted that a number of modifications could be made to the embodiment of the invention described above. Thus the detailed cooling layout of the blade could well be altered from that described; various combinations of convective, film and impingement cooling using, if necessary, apertured inserts would be known to those skilled in the art and could benefit from the use of two feed pressures caused to enter the blade in the manner of the invention.

It should also be noted that although described with reference to air cooling, other cooling fluids such as gases, vapours etc could easily be used instead with suitable modifications to the cooling arrangement.

We claim:

1. A cooled rotor blade for a gas turbine engine comprising:

an integrally cast hollow aerofoil portion, hollow shank portion, and root portion, said aerofoil portion having a leading edge, a trailing edge, and convex and concave flanks, said aerofoil portion further having a plurality of chordal-spaced and spanwise partitions extending between the convex and concave flanks from adjacent its tip portion and terminating in and/or adjacent the hollow interior of said shank portion, a hollow bush extending transversely through said shank portion and having at least one end open to the exterior of the shank portion for receiving a cooling fluid, said hollow bush engaging at least two adjacent partitions to define at least one cooling passage separate from at least another cooling passage which communicates with the hollow interior of said shank portion, said bush having an aperture in its wall opening to a space between the at least two partitions for supplying cooling fluid to the said at least one cooling passage, and a cooling fluid entry aperture in at least one of said root portion and said shank portion communicating with the hollow interior of said shank portion, said last-mentioned cooling fluid entry aperture supplying cooling fluid to the hollow interior of said shank portion and then to the said at least another cooling passage.

2. A cooled rotor blade as claimed in claim 1 in which said bush is open at both ends to the exterior of the shank portion for receiving the cooling fluid.

3. A cooled rotor blade as claimed in claim 1 in which said at least another passage includes a first passage portion adjacent the leading eadge of said aerofoil portion and a second passage portion adjacent the trailing edge of said aerofoil portion and in which said at least one passage separate from said at least another passage is intermediate said first passage portion and said second passage portion and receives a relatively lower pressure cooling fluid from said bush than said first and second passage portions receive from said cooling fluid entry aperture.

4. A cooled rotor blade as claimed in claim 3 in which said second passage portion adjacent said trailing edge is sinuous.

5. A cooled rotor blade as claimed in claim 1 in which said cooling fluid entry aperture in at least one of said root portion and said shank portion is in a base of said root portion and provides communication for cooling fluid to the interior of said shank portion and to said at least another passage.

6. A cooled rotor blade as claimed in claim 1 in which said cooling fluid entry aperture in at least one of said root portion and said shank portion is positioned solely within said shank portion and provides communication between the exterior thereof and the hollow interior of said shank portion.

* * * * *

UNITED STATES PATENT AND TRADEMARK OFFICE

CERTIFICATE OF CORRECTION

PATENT NO. 4,177,010

DATED December 4, 1979

INVENTOR(S) : Terence M. Greaves and Robert D. Summers

It is certified that error appears in the above-identified patent and that said Letters Patent are hereby corrected as shown below:

In the above-identified patent, please change

"[30] Foreign Application Priority Data
Jan. 4, 1977 [GB] United Kingdom.....13808/77" to --[30] Foreign Application Priority Data
Apr. 1, 1977 [GB] United Kingdom.....13808/77 --

Signed and Sealed this

*Twenty-sixth* Day of *February 1980*

[SEAL]

*Attest:*

SIDNEY A. DIAMOND

*Attesting Officer*

*Commissioner of Patents and Trademarks*